US009127678B2

(12) United States Patent
Gomez et al.

(10) Patent No.: US 9,127,678 B2
(45) Date of Patent: Sep. 8, 2015

(54) FAST-RESPONSE PUMP MONITORING AND IN-SITU PUMP DATA RECORDING SYSTEM

(75) Inventors: Arturo Camacho Gomez, San Diego, CA (US); Mark J. Jones, San Diego, CA (US)

(73) Assignee: Field Intelligence, Inc., San Diego, CA (US)

( * ) Notice: Subject to any disclaimer, the term of this patent is extended or adjusted under 35 U.S.C. 154(b) by 593 days.

(21) Appl. No.: 13/439,766

(22) Filed: Apr. 4, 2012

(65) Prior Publication Data

US 2013/0268213 A1 Oct. 10, 2013

Related U.S. Application Data

(60) Provisional application No. 61/516,280, filed on Apr. 6, 2011.

(51) Int. Cl.
*F04D 15/00* (2006.01)
*F04D 7/00* (2006.01)

(52) U.S. Cl.
CPC ..... *F04D 7/00* (2013.01); *F04D 15/0088* (2013.01)

(58) Field of Classification Search
CPC ..... F04D 15/0088
USPC ..... 702/33
See application file for complete search history.

(56) References Cited

U.S. PATENT DOCUMENTS

| | | | | |
|---|---|---|---|---|
| 8,400,093 | B2 * | 3/2013 | Knox et al. | 318/490 |
| 2004/0064292 | A1 * | 4/2004 | Beck et al. | 702/182 |

* cited by examiner

*Primary Examiner* — Bryan Bui
(74) *Attorney, Agent, or Firm* — Robert P. Cogan; Continuum Law

(57) ABSTRACT

A proposed implementation of this present subject matter utilizes a data collection and processing unit and sensors to monitor one or more conditions which can cause damage to a pump. These conditions include differential pressure across the pump, pump flow rate, and the pump rotational speed (RPM). Pump operating curves are analyzed to develop equations indicative of minimum and maximum allowable head for efficient operation within mechanical operation limits of the pump. The equations are used to set a processor for analyzing data inputs. The processor utilizes sensor inputs from the pump, including input and output pressure differential, flow, and pump speed. These values are compared to stored data or may be inserted into an equation to provide a calculated parameter indicative of operation in or out of pump operating limits. Responsive circuits inform users of alarm conditions.

20 Claims, 7 Drawing Sheets

FAST-RESPONSE PUMP MONITORING AND IN-SITU PUMP DATA RECORDING SYSTEM

CROSS-REFERENCE TO RELATED APPLICATIONS

This application claims priority from provisional application Ser. No. 61/516,280, entitled "Fast-Response Pump Monitoring and In-Situ Pump Data Recording System," filed on Apr. 6, 2011. The contents of this provisional application are fully incorporated herein by reference.

BACKGROUND

1. Field

The present matter relates to wireless communications and pump monitoring, and more particularly to monitoring of pump operations.

2. Background

The present subject matter is discussed in the context of an end suction centrifugal pump, although it is not so limited. One significant application is irrigation of fields. A pump is placed adjacent to a water source such as an irrigation canal. The pump is generally included in a pumping system which includes a framework supporting the unit and a driver such as a diesel engine for rotating the pump's impeller. The pumping station may be placed on skids. The pumping station is large and expensive. It may not be used year-round. Therefore, many users rent pump systems rather than buy them.

A number of operating curves may be used to describe pump performance. Curves take into account such parameters as power required to operate the pump, rotational speed, and the amount of water to be pumped. Within certain parameter value ranges, the pump will operate most efficiently. Outside of selected limits, the pump may be damaged, perhaps irreparably.

The user who rents a pumping system commonly has little knowledge of pump operating characteristics and pump maintenance. It is unlikely that such a user will have significant operating experience with the pump. The user may not know how to take action to avoid operating within parameter value ranges which will damage the pump when this condition occurs. The pump owner is generally unable to document circumstances which will demonstrate responsibility on the part of the user. In any case the pump owner would prefer to avoid damage.

The potential for large financial loss to the pump owner is present. It is also significant that the pump owner will have significant downtime when the pump is damaged. During downtime, the pump cannot operate to generate revenue to cover the expenses associated with ownership. The many different expenses include depreciation and cost of deploying the pump.

The conventional pump control unit does not respond proactively in response to current operating conditions. Generally, operations are not diagnosed to predict imminent pump failure due to select conditions.

In one form of conventional control, pump parameters are measured and then transmitted to a control facility at a remote location. Prior art systems may transmit locally generated, condition-responsive signals to remote locations for processing at a "back end" server. Control room personnel and control room processors can process data and send commands to provide changes and corrections of operational parameters.

Communications link service can be interrupted for any of a number of reasons. If a communications link is interrupted, the control systems at the back end are "blind" for the period of the interruption. During this period, conditions may occur which will damage a pump. Because the pump operator is not in a position to know the current values of parameters, a response cannot be made in view of current conditions. Consequently, the control server and control personnel are incapable of preventing damage to very expensive machinery.

SUMMARY

Briefly stated, in accordance with the present subject matter, an apparatus and method are provided which monitor pump operations and are capable of providing proactive controls at a pump location. Processing of condition-responsive signals is done locally, i.e., at a pump location. A local connection to the signals is provided. A wide area network link is not a necessity. Alarms may be generated locally in response to local conditions. In the event of a communications link interruption, the local system can store information for transmission to a control server when the communications link is restored.

A proposed implementation of this present subject matter utilizes a data collection and processing unit and sensors to monitor one or more conditions which can cause damage to a pump. These conditions include differential pressure across the pump, pump flow rate, and the pump rotational speed (RPM). Pump operating curves are analyzed to develop equations indicative of minimum and maximum allowable head for efficient operation within mechanical operation limits of the pump. The equations are used to set a processor for analyzing data inputs. The processor utilizes sensor inputs from the pump, including input and output pressure differential, flow, and pump speed. These values are compared to stored data or may be inserted into an equation to provide a calculated parameter indicative of operation in or out of pump operating limits.

The local system can also decide how much information to send to a remote server. For example, if a pump is operating steadily, the system could transmit a "non-alarm" signal periodically to the remote server. When conditions approach or exceed operation limits, the system could transmit more frequently. This reduction in data transmission provides for decreased expense for required bandwidth and simplifies data processing requirements at the server.

DETAILED DESCRIPTION

Figure 1:
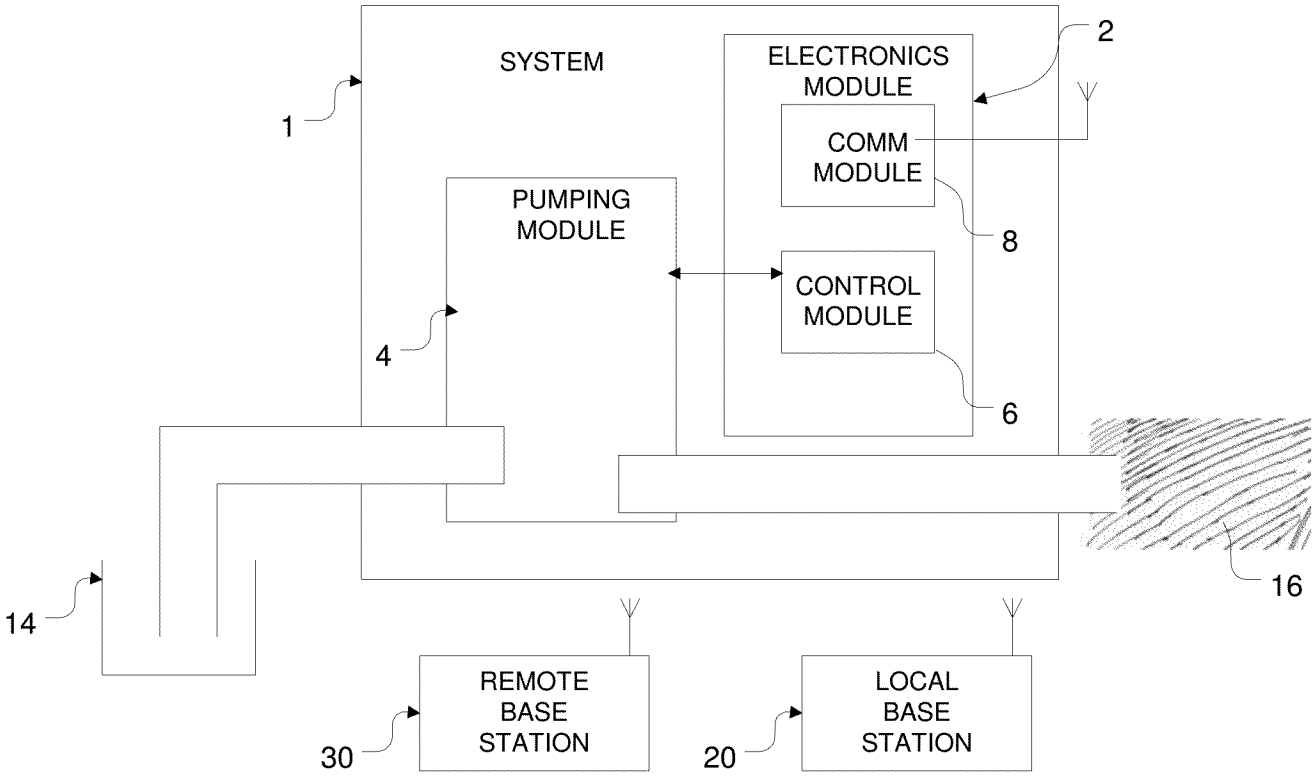
FIG. 1 is a block diagram of a system embodying the present subject matter.

FIG. 1 is a block diagram illustrating a field unit 1 embodying the present subject matter. By way of example, the present embodiment is designed for agricultural and environmental applications. However, the system is not limited to any particular application. This field unit 1 comprises an electronics module 2 and a pumping module 4. The electronics module 2 comprises a control module 6 and a communications module 8. The communications module 8 may communicate with either or both of a local base station 20 and a remote base station 30. Signals may be transmitted to the remote base station 30, for example, by satellite dish and/or cell phone link. Signals may also be collected by a satellite dish or cellular tower and provide data to the remote base station 30 via the Internet.

The pumping module 4 pumps water from a source, such as an irrigation canal 14, to a destination, which could be, for example, a crop field 16. The pumping module 4 operates in accordance with operating curves further described with respect to FIGS. 2 and 3. The control module 6 utilizes transducers, described further with respect to FIG. 4, to monitor operating parameters of the pumping module 4 which are used to characterize the nature of operation. The control module 6 may also include memory for recording data. Additionally, the control module 6 may comprise control circuitry to respond to received signals and produce control signals to command operations of the electronics module 2.

The communications module 8 transmits information to either or both of the local base station 20 and the remote base station 30. The base stations 20 and 30 may be located virtually anywhere. In one preferred embodiment, the local base station 20 is located at an office adjacent the crop field 16. The field unit 1 data is then accessible at one local physical location even though the field unit 1 may be moved to any of a number of locations within the a crop field 16. The remote base station 30 may be located at a main office of a company that leases field units 1 to growers. The base stations 20 and 30 are informed of operating conditions.

Figure 4:
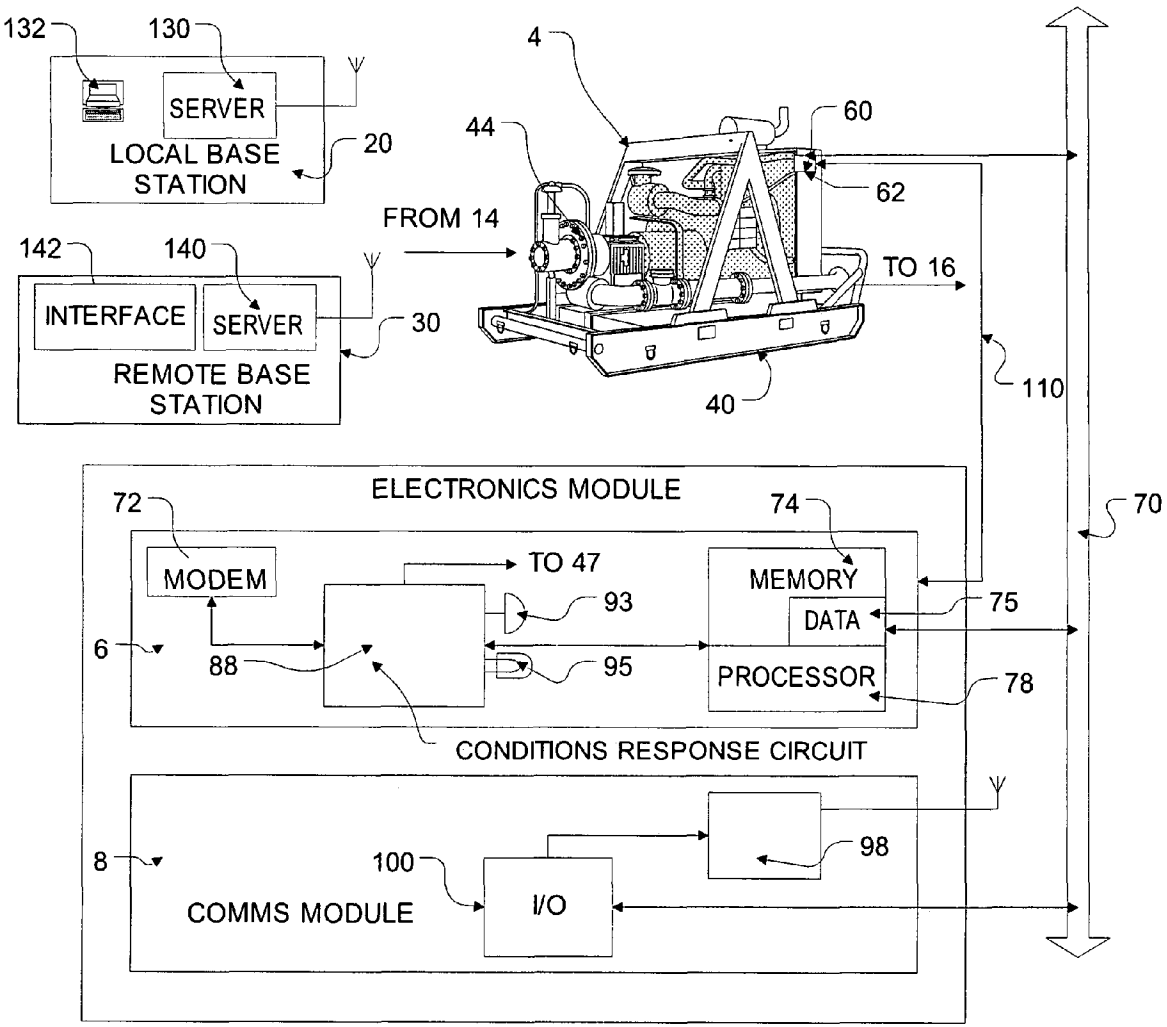
FIG. 4 is an illustration of a system in accordance with the present subject matter including an isometric view of mechanical components and a block diagrammatic representation of electronics components.

Data produced by the electronics module 2 may be processed in any of a number of ways, for example, as discussed with respect to FIG. 4. In one embodiment, the electronics module 2 records operating data, but does not control operations. The pump owner may have a record of pump operations. In this manner, the pump owner can document if damage was due to negligent operation by the pump operator.

Various options exist for processing data and using it to control operation. The electronics module 2 may include processing circuitry for local, automatic control of operation in response to condition responsive signals. In another embodiment, information may be processed at the base station 20, and control signals may be sent to the local control module 6 in the electronics module 2. Information may be transmitted to the remote base station 30 either directly or via the local base station 20. In another alternative the electronics module 2 may be interact with instructions transmitted directly from the remote base station 30. Further alternatively, instructions may be provided from the remote base station 30 to personnel at the local base station 20 to make adjustments locally.

Communication with the remote base station 30 may provide for interactive control. However, if a communications link with the remote base station 30 is lost, then the remote base station 30 is without input information describing operation of the pumping module 4. The field unit 1 can operate by itself to prevent and/or record "out-of-limits" operation so that damage can be avoided even if there is no communication with the remote base station 30.

Figure 2:
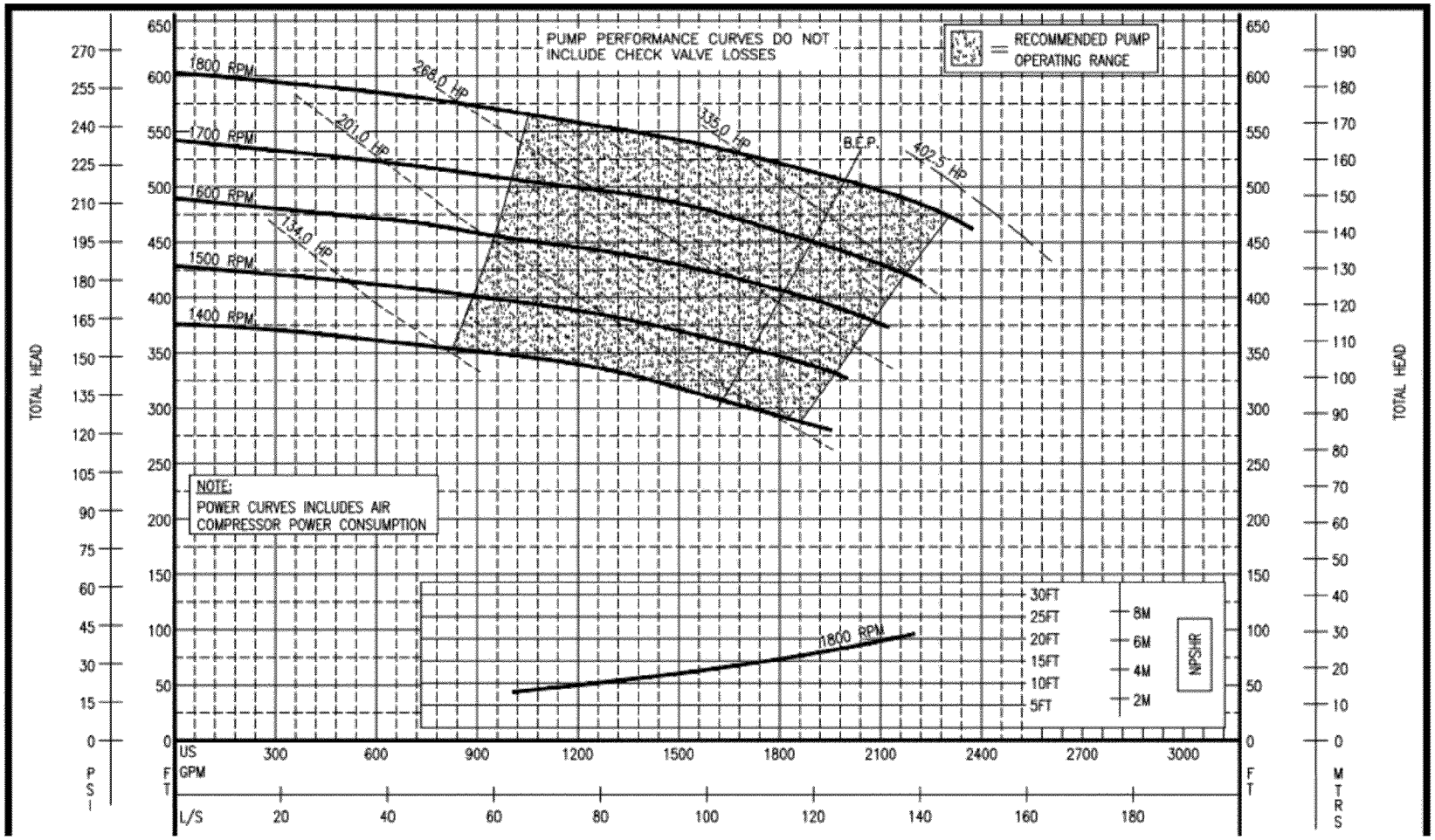
FIG. 2 is a typical pump operating curve.

FIG. 2 is a depiction of a typical pump operating curve. The abscissa is flow in both metric and English units, and the ordinate is maximum head in meters and feet for a selected pump. In a preferred embodiment, the pumping module 4 comprises a centrifugal pump 44 (FIG. 4). Fluid enters the pump throne, the eye of an impeller which rotates at high speed. The fluid is accelerated radially outwardly. A vacuum is created at the impeller's eye that continuously draws more fluid into the pump and discharges the fluid to create head. A pump's head indicates a difference between input pressure and output pressure. Head is the vertical lift in height, generally measured in feet or meters of water, to which the pressure generated by the pump can lift water. Head is measured vertically from a centerline of the pump to the height of a discharge outlet. This is also known as static head. Dynamic head is the sum of static head and friction in the pump's suction. Dynamic head is a value used in horsepower calculations for pump operation.

FIG. 2 is a nominal operating curve for a selected pump. In the present illustration, an XH 150 centrifugal pump is used. The XH-150 pump is an end suction centrifugal pump with an automatic priming system. The priming system utilizes a standard air compressor, which feeds a pneumatic ejector mounted above the air/water separation tank. With this device, suction lifts up to 28 ft. (8.5 m) can be achieved. The pump uses an impeller with a five blade, stainless steel closed construction design, with an eye diameter of 6.85" (174 mm). The impeller is mounted on a 431 stainless steel shaft fitted to a cast iron bearing bracket; which also provides concentric location for the pump volute. A number of manufacturers make an XH 150 pump. One example is the XH-150 pump available from Western Oil Services Company under the trademark PowerPrime.

Each curve in FIG. 2 illustrates head versus flow rate for one value of rotational speed of the impeller of the pump 44. A centrifugal pump operates at the point on its performance curve where its head matches the resistance in the pipeline. The point on the curve where the flow and head match the application's requirement is known as the duty point. A duty point can be established by varying such parameters as pump speed or impeller vane length.

Various conditions, e.g., change of height of water in the irrigation canal 16 (FIG. 1), can cause an operating point to move to the right as seen in FIG. 2. This may be characterized as a decrease in head and an increase in pump speed. When head versus pump speed decreases below a given level, cavitation results. Cavitation is the collapse of bubbles that are formed in the eye of the impeller due to low pressure. The implosion of the bubbles on the inside of the vanes creates pitting and erosion that damages the impeller. In order to avoid allowing operation which will damage the pump 44, limits need to be determined for head versus pump speed.

Figure 3:
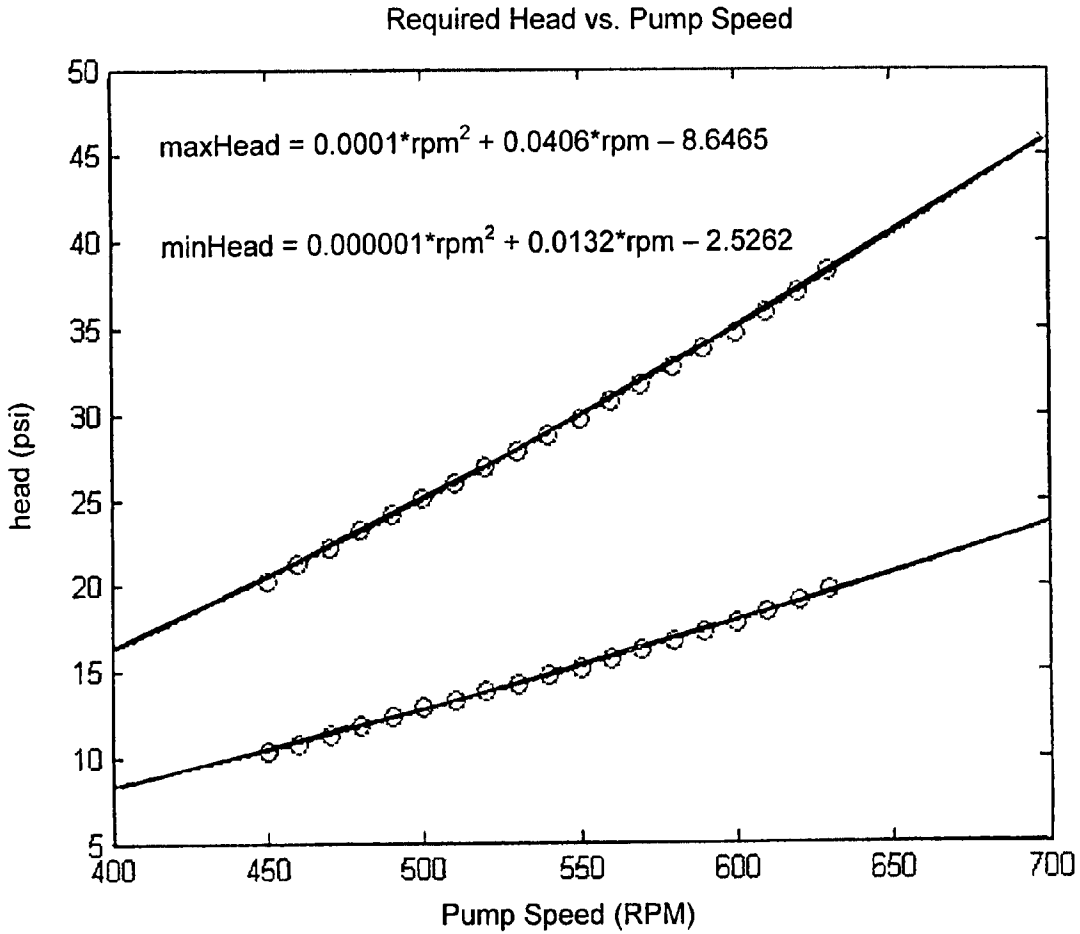
FIG. 3 is a depiction of a curve fitting technique for simplifying alarm detection.

FIG. 3 is a depiction of a curve fitting technique for simplifying alarm detection. The curve fitting technique utilizes the relationship of head to rotational pump speed. The head versus speed relationship is a quadratic function with constants being inherent to particular pumps and applications. The lower curve of FIG. 3, Minimum Head, represents pairs of values defining a ratio below which cavitation will occur. The higher curve of FIG. 3, Maximum Head, represents pairs of values defining a ratio above which pump overload will occur. Measurement of operating parameters can be made, and the values are correlated to the points on FIGS. 2 and 3 at which a pump 44 operates. Consequently, values can be determined which are indicative of "out-of-limits," or "alarm condition" operation.

The advantages of the present subject matter include, without limitation, the ability to detect improper pump operations automatically, and to provide both local and remote alarm indications when the improper operation occurs.

Figure 5:
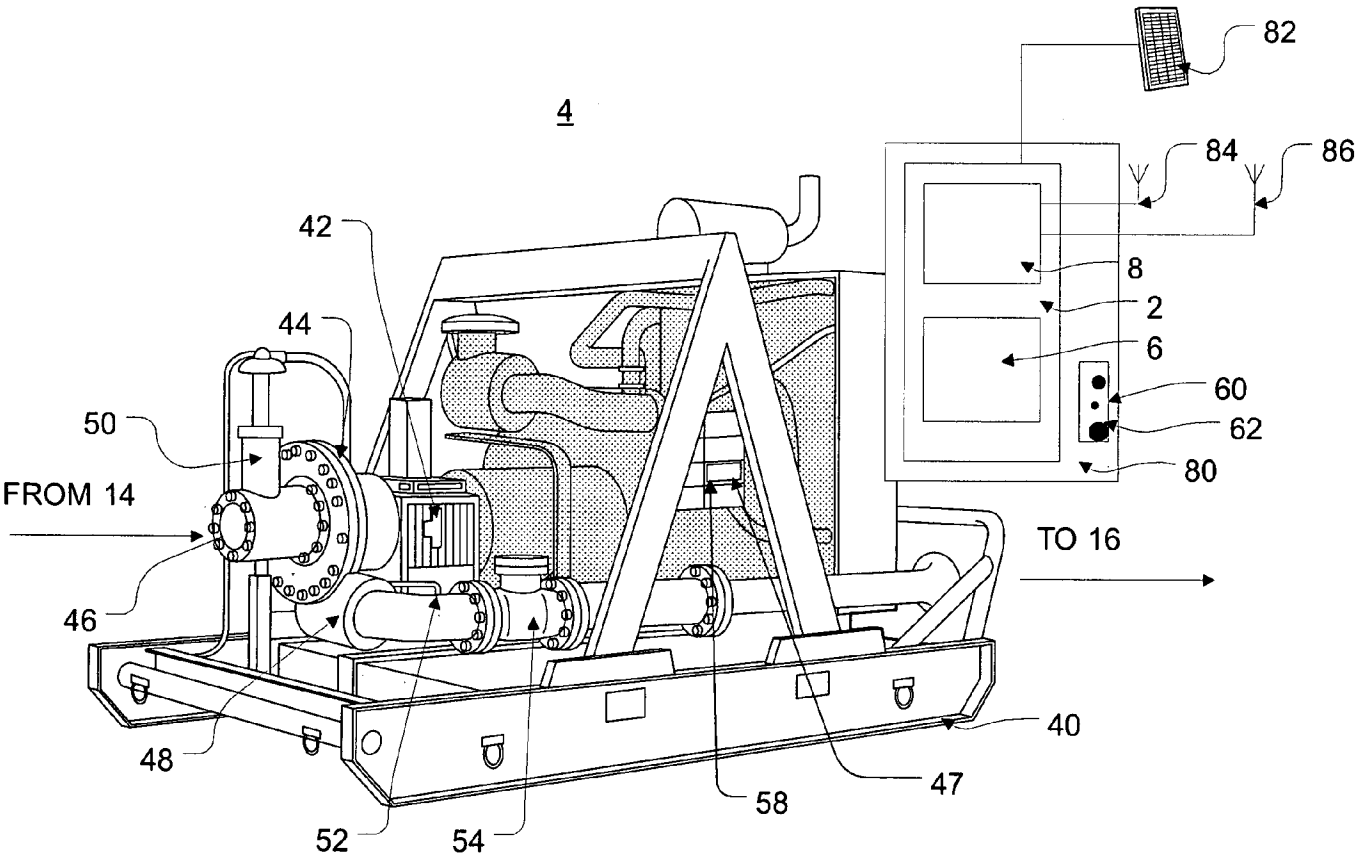
FIG. 5 is an enlarged isometric view of the pumping module.

FIGS. 4 and 5 taken together illustrate one form of the field unit 1 in greater detail. FIG. 4 is a block diagram of an electronics module 2 according to the present subject matter and an isometric view of the pumping module 4. FIG. 5 is an enlarged isometric view of the pumping module 4.

The field unit 1 may comprise a skid 40 on which components are mounted. The skid 40 facilitates transporting the field unit 1 into a location adjacent the first location 14 (FIG. 1). A pump driver 42 provides motive power to the pump 44. In the present embodiment, the pump driver 42 is a diesel engine. The pump driver 42 may be operatively coupled to a motor controller 47 (FIG. 5). Other prime movers may be utilized. One alternative is an electric motor. However, a diesel engine is generally better suited for high volume pumping applications of heavy fluid such as water. The pump 44 is, in one preferred form, a centrifugal pump 44 having a suction inlet 46 and an outlet 48.

Transducers, more particularly described below, provide inputs to the control module 6 which are indicative of various values that describe operation of the pump 44 comprise inputs to the control module 6. The set of transducers in the field unit 1 is referred to collectively as the sensors 62. The sensors 62 do not define a closed set. The sensors 62 may be included in a sensor module 60. Transducers in addition to those described below may be provided. The inputs may be either analog or digital.

The sensors 62 may include a suction pressure sensor 50, which senses input pressure at the inlet 46. A discharge pressure sensor 52 senses pressure at the outlet 48. A flowmeter 54 measures volume of liquid pumped. In irrigation applications, the liquid will be water. A pump speed indicator 58 monitors speed of the pump 44, generally in rpm. The sensor module 60 communicates with the control module 6 to receive and process signals from the sensors 50, 52, 54, and 58. The sensor module 60 may or may not be located within the control module 6.

It is not essential to have a discrete interface and control module 6 at the pumping module 4. The control module 6 is used as a device in the description to indicate that data is coupled from sensors at the pump 44 for processing. This may be done in a number of ways. In one implementation, the suction pressure sensor 50, the discharge pressure sensor 52, and the flowmeter 54 are each coupled by a respective wire pair to provide DC signals to the control module 6. The sensor module 60 may incorporate an analog to digital converter to provide a digital signal to the bus 70. In one embodiment, the pump speed indicator 58 is coupled to the control module 6 via the sensor module 60 by a CAN (Controller Area Network) bus 110. The CAN bus 110 is designed to a standard to allow microcontrollers and devices to communicate with each other within a vehicle without a host computer.

The electronics module 2 may be enclosed in an enclosure 80 (FIG. 5) such as an NEMA 4X enclosure 80. A solar panel 82 may be provided to allow completely untethered operation. A satellite or cellular whip antenna 84 and a GPS antenna 86 may be coupled to the communications module 8 for communication with the base stations 20 and 30.

The sensors, the control module 6, and the communications module 8 communicate via a bus 70. The control module 6 comprises a processor 78 and a memory 74. The memory 74 is preferably a non-volatile memory. The processor 78 receives signals via the data bus 70 and processes condition responsive signals as described above with respect to FIGS. 2 and 3. A condition-responsive circuit 88 is provided to process data from the sensor module 62. Signals produced include alarm signals and control signals. There are two states for a signal indicative of an alarm. One state is an out-of-limit condition. The other state may be called "normal," "in-limits," or the absence of an out-o-limit condition. The motor controller 47 is coupled to the condition-responsive circuit 88. The condition-responsive circuit 88 provides commands to the motor controller 47. The commands may command the motor controller 47 to shut down the pump driver 42 or to adjust operating parameters. The condition-responsive circuit 88 is provided with criteria and coupled to select manual local control or control transmitted from a remote location such as the remote base station 30. For example, the condition-responsive circuit 88 may command local control when communications with the remote base station 30 are interrupted.

The memory 74 may be provided with and may store fixed physical constants, instruction sets, pump limits, curve fit equations, and settable levels to which to compare unprocessed or processed sensor outputs. If the processed output is outside the pump operating limits, an alarm will be issued and data saved to the memory 74 until such time that the alarm has cleared. An alarm message will be sent to a field wireless modem 72 for transmission to remote locations. Optionally, the alarm condition can be placed on the electronic bus 70 of the motor controller 47, if one is included in a particular embodiment, for display and control. Alarm messages may continue at a configurable interval until the alarm clears.

The communications module 8 comprises an I/O (input/output) card 100 that provides an interface to the bus 70. The I/O card 100 also is coupled to a communications link 98 in the communications module 8. The communications link 98 is preferably a full duplex communicator. The communications link 98 can take one or more of the following forms: satellite radio, a cellular module, a local area network modem, or other communication means. In another form, the communications link 98 can provide one-way communications from the communications module 8.

The field unit 1 may be constructed in a modular manner so that it can be assembled and mounted easily, and then locally switched on to begin data collection and data delivery. The remainder of the operation is intended to be completely unattended. Basic operating parameters can be configured such as data delivery, sleep intervals, sensor configuration, sensor read interval, alarm levels, and battery voltage set points. The unit is fully duplex for remote management and can be made at reasonable cost to include enough memory to log over one years' worth of continual measurements.

The processor 78 compares selected values from the sensor module 60 to threshold levels from the memory 74 and supplies inputs to the condition-responsive circuit 88. The condition-responsive circuit 88 operates devices to indicate selected conditions. In the present illustration, an audible alarm 93 and a lamp 95 are used to indicate alarm conditions. Many other devices could be provided. The lamp 95 could also be operative to provide a first or a second color to indicate normal operation or an alarm condition respectively. The lamp 95 could comprise, for example, a plurality of light emitting diodes (LEDs) of first and second, or more, colors.

In a preferred form, the processor 78 produces control signals which are provided to the interface and control module 6 for adjusting values of operating parameters of the pump 44.

In FIG. 1 as well as in FIGS. 4 and 5, components are located to perform their functions. The description of a component as being in a particular module is for convenience, and is not limiting as to its physical location in the field unit 1.

The local base station 20 may conveniently comprise a server 130 and a personal computer 132. The server 130 may, for example, present data to the personal computer 132 as an Internet web page. The local base station 20 receives alarms.

Owner personnel at the local base station 20 may use other communications means to contact user personnel. Additionally, the local base station 20 may provide operator generated or computer generated control signals for transmission to the control module 6. The control signals may be utilized to vary operating parameters of the pump 44 or to shut it off. It will generally be preferable to produce control signals at the control module 6. In many applications, the local base station 20 will be remote from the electronics module 2. However, this is not necessary.

The remote base station 30 includes a server 140 to interact with an interface device 142. The interface device 142 couples the remote base station 30 to the bus 70.

With the alarm data saved to the memory 74, a historical record of improper operations is maintained that can be used to identify causes of pump failure and damage. A memory module may be included in the memory 74 as a separate location from which historical data may be access. Automatic alarm notifications allow personnel to take corrective actions when the pump is being operated outside of limits, preventing pump failure and/or damage. The curve fitting of the pump operating curve reduces the memory and processing required to detect an out-of-band condition, and provides a technique for determining improper operations at any pump speed. The system is capable of switching between curves automatically as defined by the application program and configuration parameters.

Figure 6:
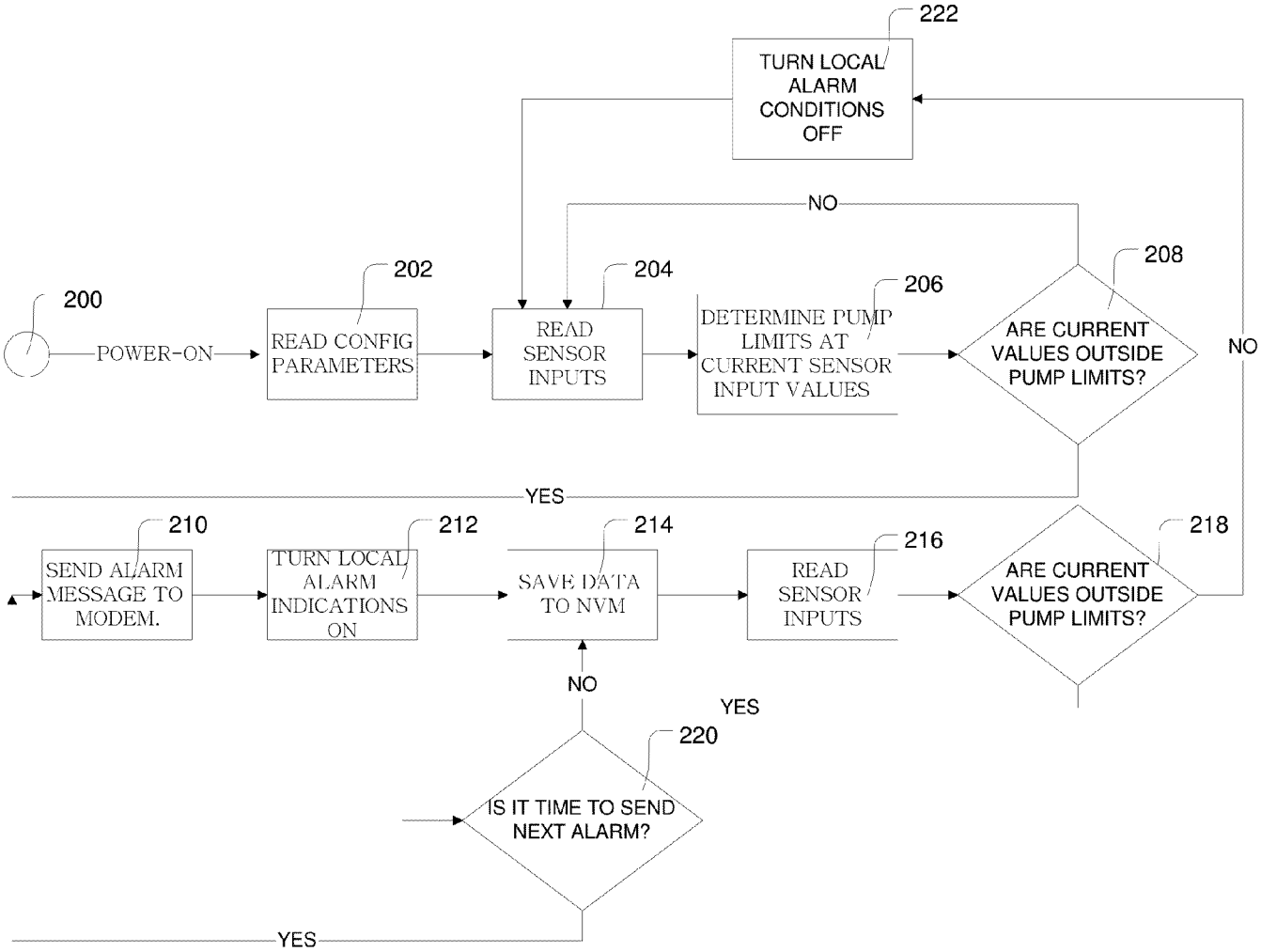
FIG. 6 is a flowchart of the processing that occurs within the data collection and processing unit.

FIG. 6 is a flow chart demonstrating the operation of the pump monitoring and alarm algorithm that occurs within the electronics module 2. Operation begins at block 200 with power-on. Configuration parameters are read 202. The sensor inputs required for the pump protection algorithm are pump differential pressure, flow, and pump speed. These values are read 204. The sensor inputs values are then compared to a tabular or equation form of the pump operating limits 206, and if outside the limits 208, a remote and/or local alarm is issued 210, 212. The alarm data is saved to memory 214. The process continues at a configurable interval when the sensor inputs are read again 216. If the pump operating limits continue to be violated 218, further alarm messages are sent 220 at a configurable interval. When the pump begins operating within its limits, the alarm condition is turned off 222 and the process of reading the sensor inputs 204 and comparing them to the alarm limits 206 continues indefinitely.

Figure 7:
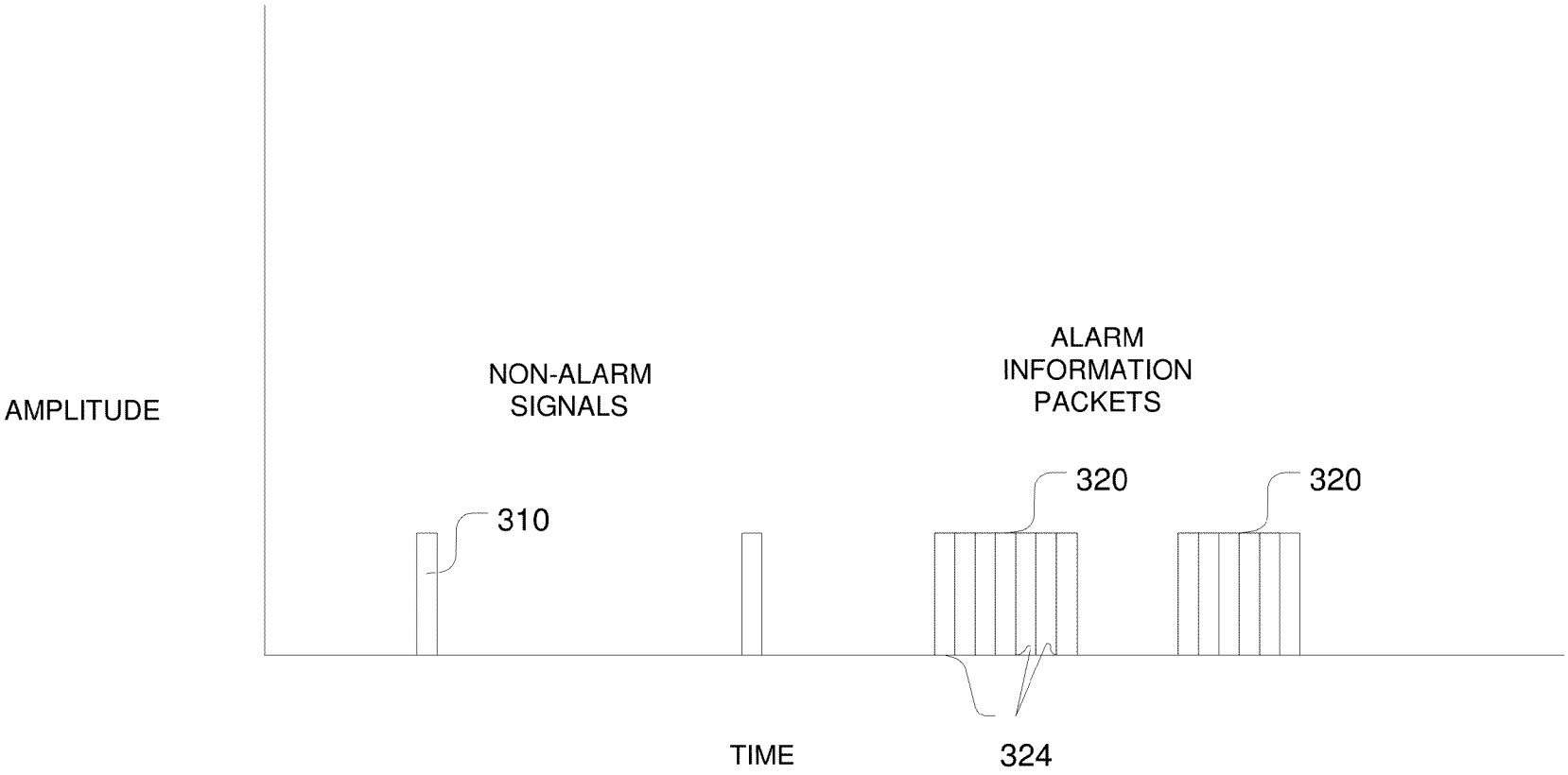
FIG. 7 is a waveform chart illustrating transmission of data from the pump system to a remote system.

FIG. 7 is a waveform chart of signals produced by the condition responsive circuit 88. In FIG. 7, the abscissa is time, and the ordinate in signal height in arbitrary units. Signals representing the values of operating parameters go to the condition-responsive circuit 88. The signals may be translated to the communications module 8. However, a comparison may be made so that when the system is operating nominally, a non-alarm signal 310 is produced periodically. The bandwidth of a non-alarm signal is narrower than the bandwidth required for parameter data. Full data can be sent to the remote database 30. When an alarm condition occurs, packets 320 are produced having field 324 in the packet architecture. These fields provide specific operation data. Other forms of signals than digital packets may be generated and utilized.

While the foregoing written description of the present subject matter enables one of ordinary skill to make and use what is considered presently to be the best mode thereof, those of ordinary skill will understand and appreciate the existence of variations, combinations, and equivalents of the specific embodiment, method, and examples herein. The present subject matter should therefore not be limited by the above described embodiment, method, and examples, but by all embodiments and methods within the scope and spirit of the present subject matter.

What is claimed is:

1. A centrifugal pump monitoring system for monitoring operation of a pump, a structure of the pump corresponding to an operating curve, comprising: sensors positioned to monitor performance parameters of a centrifugal pump and provide sensor outputs each indicative of a value thereof, a reading circuit to process sensor outputs, and a processor containing parameter limits defined by the operating curve of the pump, the operating curve defining operation over a range of head versus a range of flow rate, the processor coupled to compare sensor outputs to respective parameter limits and to produce an out-of-limit signal in response to values outside of the respective parameter limits.

2. A centrifugal pump monitoring system according to claim 1 further comprising alarm systems, the alarm system being configured to produce an alarm signal in response to an out-of-limit signal.

3. A centrifugal pump monitoring system according to claim 2 further comprising a memory coupled to store alarm signals.

4. A centrifugal pump monitoring system according to claim 3 wherein the alarm signal comprises data indicative of a time at which the alarm signal is produced.

5. A centrifugal pump monitoring system according to claim 4 wherein the alarm signal further comprises data indicative of the value of each out of limit signal.

6. A centrifugal pump monitoring system according to claim 5 wherein said alarm system comprises a clock circuit to control periodic measurement of the sensor output values and continually sense presence or absence of an alarm condition.

7. A centrifugal pump monitoring system according to claim 6 wherein the sensor comparison system produces a reset signal to reset the alarm condition in response to a measurement indicative of absence of out-of-limit signals.

8. A centrifugal pump monitoring system according to claim 7 further comprising a circuit for providing an input to the memory indicative of production of a reset signal.

9. A method for monitoring operation of a pump, a structure of the pump corresponding to an operating curve of the pump, comprising: sensing performance parameters of the pump and providing sensor outputs each indicative of a value thereof, processing sensor outputs, providing a processor containing parameter limits defined by the operating curve of the pump, the operating curve defining operation over a range of head versus a range of flow rate, comparing current sensor output values to respective parameter limits, and producing an out-of-limit signal in response to a value of a selected parameter outside of respective parameter limits.

10. A method for monitoring a centrifugal pump monitoring system according to claim 9 further comprising producing an alarm signal in response to an out-of-limit signal.

11. A method for monitoring a centrifugal pump monitoring system according to claim 10 further comprising storing alarm signals.

12. A centrifugal pump monitoring system according to claim 11 wherein the alarm signal comprises data indicative of a time at which the alarm signal is produced.

13. A centrifugal pump monitoring system according to claim 12 wherein producing the alarm signal further comprises providing data indicative of the value of each out of limit signal.

14. A centrifugal pump monitoring system according to claim 13 wherein sensing performance parameters comprises periodically measuring the sensor output values and continually sensing presence or absence of an alarm condition.

15. A centrifugal pump monitoring system according to claim 14 further comprising producing a reset signal to reset the alarm condition in response to a measurement indicative of absence of out-of-limit signals.

16. A centrifugal pump monitoring system for monitoring operation of a pump, a structure of the pump corresponding to an operating curve, comprising: sensors positioned to monitor performance parameters of a centrifugal pump and provide sensor outputs each indicative of a value thereof, a reading circuit to process sensor outputs, a processor containing parameter limits defined by the operating curve of the pump, the operating curve defining operation over a range of head versus a range of flow rate and a comparison circuit comparing each sensor output to a respective parameter limit and producing an out-of-limit signal in response to a selected parameter's being outside of the parameter limits, and a signal generation circuit for providing a selected form of signal in correspondence with a state of the out-of-limit signal.

17. A centrifugal pump monitoring system according to claim 16 further comprising a wireless link responsively coupled to said signal generation circuit and an out-of-limit signal is coupled to select transmission of a signal having a bandwidth for bearing intelligence indicative of operating parameters and wherein the absence of an out-of-limit signal selects transmission of a binary value indicative of the absence of an out-of limit signal.

18. A centrifugal pump monitoring system according to claim 17 wherein the binary value signal comprises a periodic signal.

19. A centrifugal pump monitoring system according to claim 16 further comprising a motor controller operatively coupled to the condition-responsive circuit for producing a signal to change operation of the monitored pump in response to an out-of limit signal.

20. A centrifugal pump monitoring system according to claim 16 wherein said condition-responsive circuit is coupled to select manual local control or control transmitted from a remote location.

* * * * *